United States Patent [19]

Nissen

[11] 4,242,854

[45] Jan. 6, 1981

[54] AUTOMATIC BAG LOADER

[75] Inventor: Walter D. Nissen, Appleton, Wis.

[73] Assignee: Kimberly-Clark Corporation, Neenah, Wis.

[21] Appl. No.: 59,665

[22] Filed: Jul. 23, 1979

[51] Int. Cl.[3] ..... A65B 63/02; B65B 35/56

[52] U.S. Cl. ..... 53/529; 53/544; 53/573; 53/252; 53/386; 100/177

[58] Field of Search ..... 53/529, 544, 571, 573, 53/252, 386; 100/177

[56] References Cited

U.S. PATENT DOCUMENTS

| | | | |
|---|---|---|---|
| 3,139,714 | 7/1964 | Hall | 53/529 X |
| 3,645,060 | 2/1972 | Hammond . | |
| 3,722,358 | 11/1955 | Wilson . | |
| 3,789,573 | 2/1974 | Crabb . | |
| 3,810,344 | 5/1974 | Evans et al. | 53/529 |
| 4,148,169 | 4/1979 | Zike . | |

FOREIGN PATENT DOCUMENTS 1540218 2/1979 United Kingdom .

*Primary Examiner*—Travis S. McGehee

*Attorney, Agent, or Firm*—William D. Herrick; Wendell K. Fredericks

[57] ABSTRACT

An automatic bagging system useful for packaging a stack of a compressible material, such as a stack of folded disposable diapers into a drawstring type plastic bag. The apparatus includes means for compressing gradually the stack of diapers while reorienting the stack so that when the stack is packaged, the diapers will fit snugly in the bag with the folded portion of the diaper near the open end of the bag, for convenience in removing each diaper from the bag. Further the apparatus comprises means for handling and conditioning the bag for the insertion of the diaper stack that includes collapsible funnels for holding the bag open in a box-like shape in order to receive the compressed stack of diapers.

6 Claims, 11 Drawing Figures

AUTOMATIC BAG LOADER

BACKGROUND OF THE INVENTION

1. Field of the Invention

The present invention relates generally to automatic bagging systems and particularly to a system for automatically compressing a stack of compressible materials such as disposable diapers and bagging the diapers in a drawstring type plastic bag.

2. Description of the Prior Art

Packaging techniques for packaging compressible material in containers have included the method of compressing a stack of compressible material and then packing the compressed stack into a carton container. For a discussion of this technique, see U.S. Pat. No. 3,645,060 issued Feb. 29, 1972 to Philip G. Hammond.

Another technique for packaging compressible material in a container is described in British Pat. No. 1,540,218 issued Feb. 7, 1979 to Edward Alan Lister and Graham Wilson Clarke. This patent discloses a technique for inserting compressible articles into a preformed bag by partially opening an edge of the bag with air jets and then pivoting a funnel into the bag. The pivoting of a funnel into a bag which has been partially opened by air appears to be an inefficient procedure for loading compressible items into the bag since the funnels must pivot in and out of the bag within the stream of air. Such action could affect the bag opening operation performed by the jet of air.

A further apparatus for bagging articles is described in U.S. Pat. No. 4,148,169 issued Apr. 10, 1979 to Donald R. Zike. There, a automatic bagging machine is described that includes control mechanism that actuates arms to pick up and spread a plastic bag at a pick-up station which grips and maintains the bag open for filling at a filling station. However, this apparatus appears to be for packing commodity in plastic bags; it does not appear to be suitable for packing stacks of compressible material in a plastic bag.

BRIEF SUMMARY OF THE INVENTION

The present invention relates to a system for loading a stack of diapers into a drawstring plastic bag. The system interfaces with a diaper making machine which supplies stacks of folded diapers systematically and in consecutive order. The apparatus includes means for systematically orienting each stack of diapers so that when the diapers are packaged the folded end of each diaper in the stack is conveniently placed at the open end of the plastic bag. This orienting means also compresses the stack to a chosen height so that the stack of diapers, when packaged, will fit snugly in the bag.

Further means are provided for opening each bag and retaining the bag opened during bagging.

BRIEF DESCRIPTION OF THE DRAWINGS

Referring to the drawing figures, in which like numerals represent like parts in the several views.

DESCRIPTION OF THE PREFERRED EMBODIMENT

Figure 1:
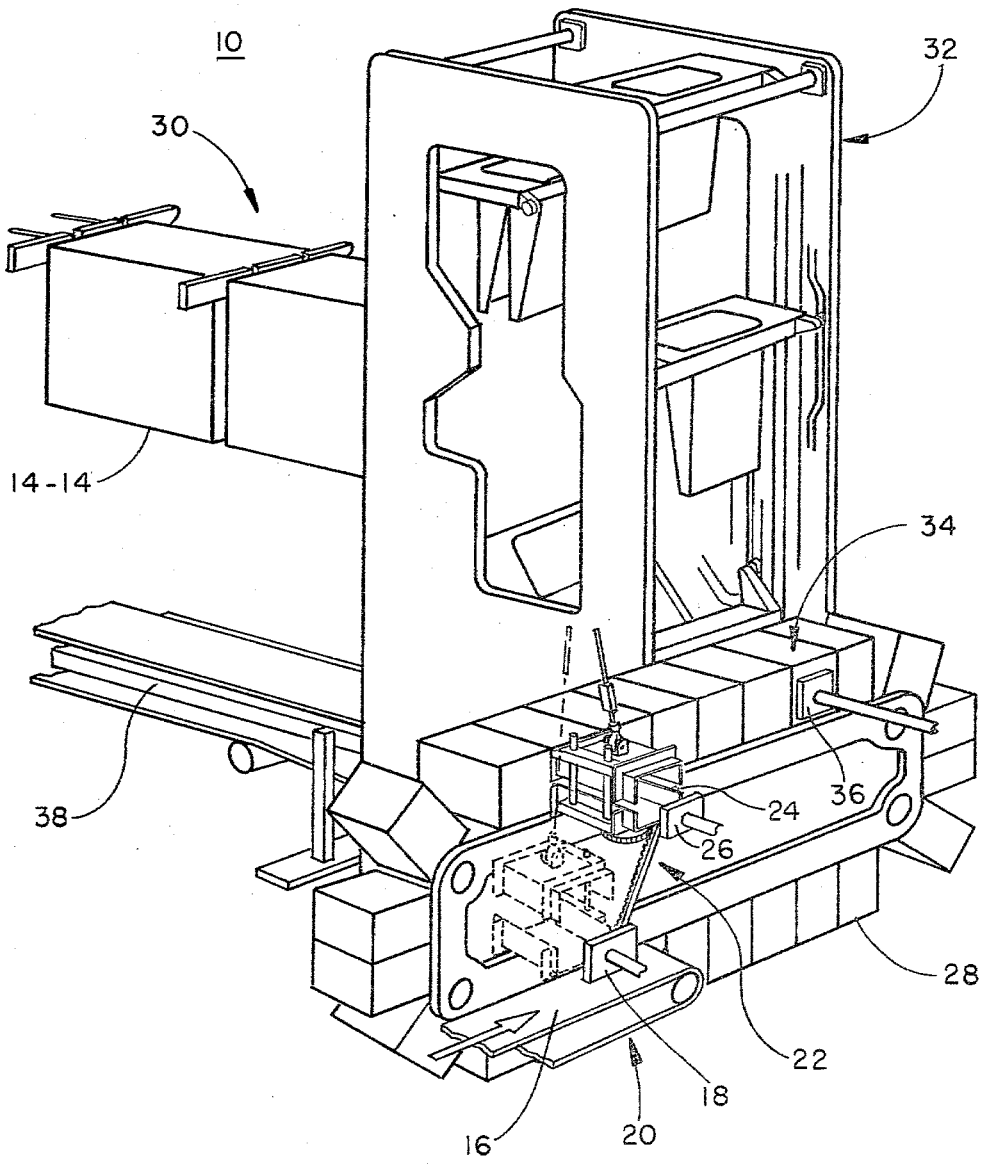
FIG. 1 is a perspective view of an embodiment of the automatic bagging system for bagging stacks of diapers into a drawstring plastic bag.
Figure 2:
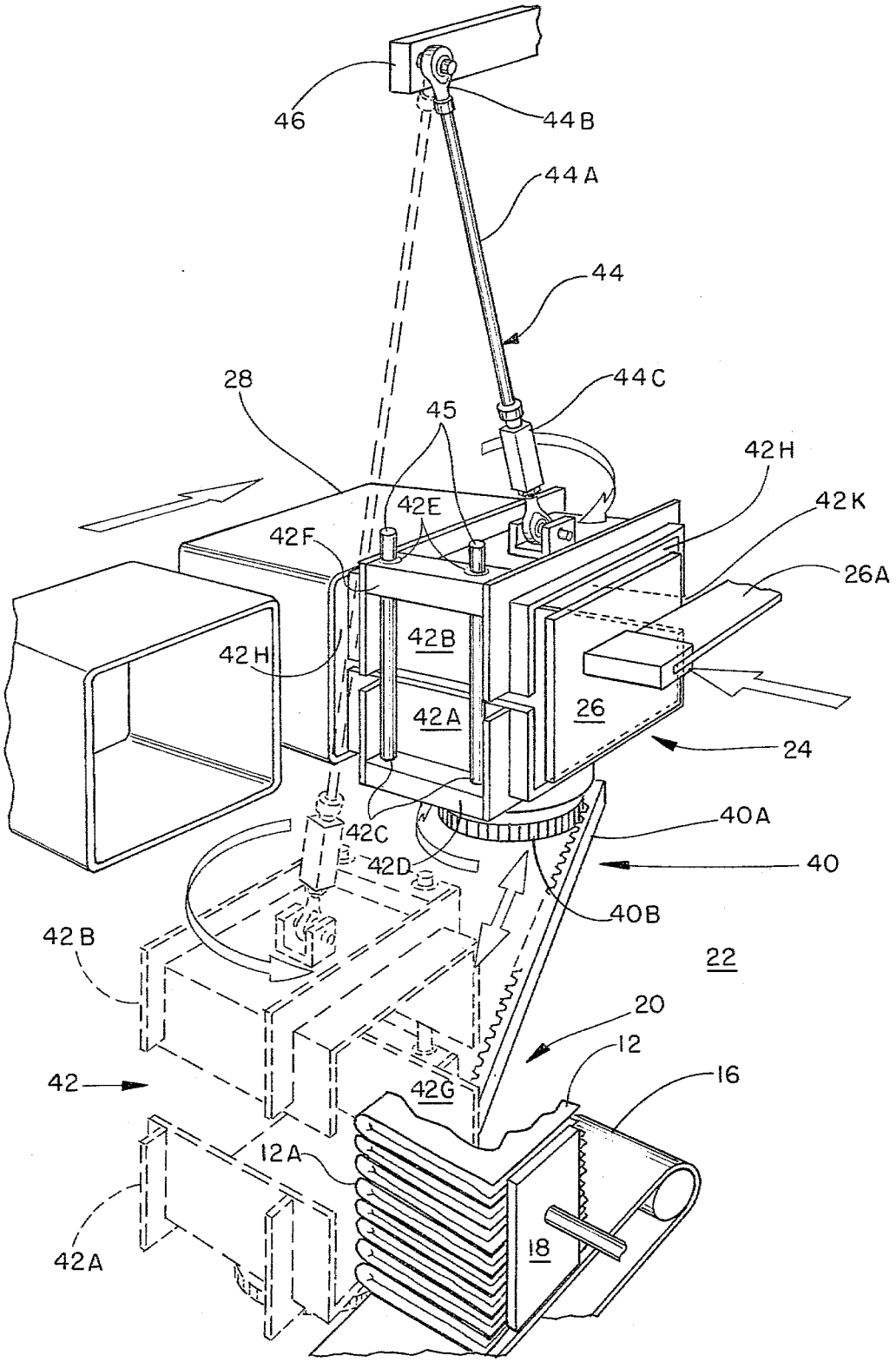
FIG. 2 is a perspective view of a shuttle bucket mechanism for gradually compressing the stack of diapers while reorienting the stack so that the folded end of the diapers will face the open end of the bag.
Figure 3:
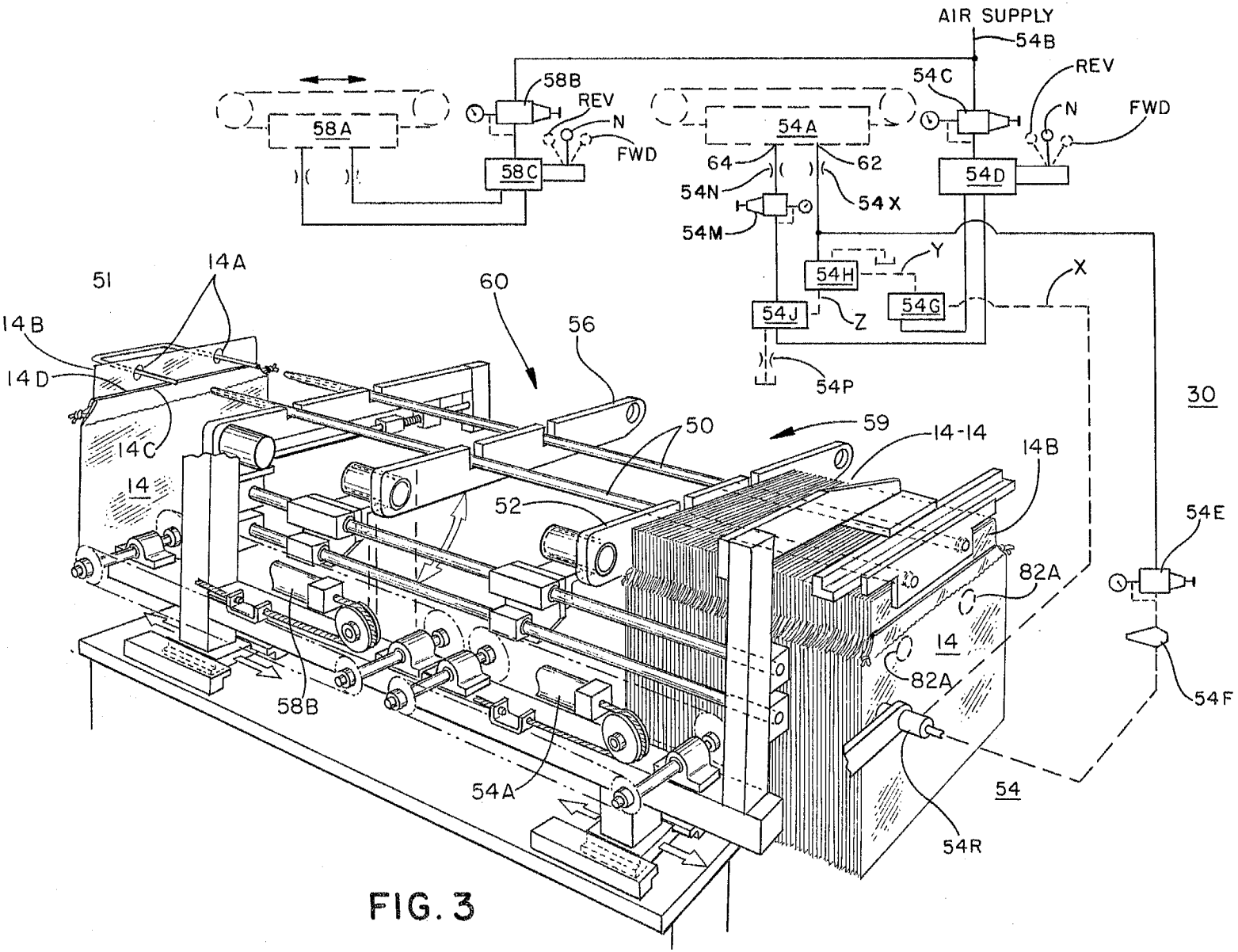
FIG. 3 is a perspective view of a bag supply magazine with controls illustrated in an accompanying schematic diagram.

Referring to the drawing figures, there is shown in FIGS. 1–4, an automatic bagging system 10 for bagging a stack of diapers 12 best seen in FIG. 2 into a drawstring plastic bag 14 best seen in FIG. 3. Stacks of diapers are systematically and consecutively fed to bagging system 10 from a step-indexed supply conveyor 16 by a reciprocating stack removal plunger 18 of a diaper making machine (not entirely shown). Prior to operation, a supply of bags are manually loaded into the bagging system; this manual operation will be explained infra.

System 10 comprises an input station 20, a shuttle bucket mechanism 22, a shuttle bucket unloading station 24, a shuttle bucket unloading plunger 26, a conventional step-indexed bucket conveyor 28, a bag supply magazine 30, an automatic bag handling and conditioning mechanism 32, a bag loading station 34, a bag loading plunger 36 and a package take-away conveyor 38.

Referring now to FIG. 2, there is shown a functional perspective view of the shuttle bucket mechanism 22. Mechanism 22, a diaper stack orientor, comprising a turntable 40, a bucket 42 and a gimbal mechanism 44, is disposed between the input station 20 and the shuttle bucket unloading station 24. Station 24 is a transfer station for transferring a stack of diapers to a bucket of the bucket conveyor 28.

Turntable 40, mounted to a support member (not shown) of bagging system 10, comprises a rack 40A, a pinion 40B and a reciprocating drive means (not shown). Rack 40A, being positioned between input station 20 and shuttle bucket unloading station 24, contains suitable meshing teeth to cause pinion 40B to rotate clockwise approximately 180° when pinion 40B is driven forward along the rack by the reciprocating drive means from station 20 to station 24 and to rotate 180° counterclockwise when driven back to station 20.

Bucket 42, a two-section bucket, has a bottom section 42A fixedly mounted to a top surface of pinion 40B of turntable 40 and a top section 42B swivelledly hinged to gimbal mechanism 44. Top section 42B is also slidably linked to bottom section 42A by a pair of rigid dowels 45. Dowels 45 have a first end fixedly seated in a pair of recess regions 42C in a first bracket 42D mounted to a first side of bottom section 42A and a second end slidably received in a pair of apertures 42E in a second bracket 42F mounted to a first side of top section 42B. Bucket 42 has an entrance chamber 42G for receiving stacks of diapers 12 at input station 20 and an exit chamber 42H, a compressible chamber, for compressing the stack of diapers prior to loading the diapers into a bag 14.

Gimbal mechanism 44 includes a rigid shaft 44A having a universal ball joint 44B at one end of shaft 44A and a swivel bearing 44C at the other end. Joint 44B is pivotally hinged to a gimbel mounting bracket 46 while bearing 44C is pivotally hinged to a top surface of top section 42B of the two-section bucket 42. Gimbal mounting bracket 46 is located on the structure of bagging system 10 at a location at a chosen height above turntable 40 such that the distance between the top surface of pinion 40B and bracket 46 is shorter when pinion 40B is moved to the input station 20. Gimbal mechanism 44 is coupled to top section 42B of bucket 42 in the above-described manner to cause the entrance chamber 42G to gradually decrease in height as the bucket 42 is rotated clockwise toward unload station 24 whereat exit chamber 42H is established. Further, a narrow slot 42K is formed between top and bottom sections 42B and 42A respectively of bucket 42 for providing a passageway for an arm of the shuttle bucket unloading plunger 26 to travel during transfer of the stacks to the bucket conveyor 28.

In operation of the automatic bagging system 10, shuttle bucket mechanism 22 is used to transfer stacks of diapers 12—12 from the indexing supply conveyor 16 of the diaper making machine to the indexing bucket conveyor 28 of the system 10. The automatic bagging system is adapted to work in synchro with the diaper making machine, i.e., for each cycle required for the diaper machine to supply a stack of diapers on conveyor 16 and then later at input station 20, the bucket conveyor 28 supplies a bucket at shuttle bucket unloading station 24. Illustratively, the diaper machine supplies a stack of diapers at station 20 at a rate of twenty stacks per minute, thus every three seconds the system 10 supplies a bucket of bucket conveyor 28 at station 24 for receiving the stack of diapers 12.

The reciprocating stack removal plunger 18 is used to consecutively remove the stack of diapers 12 from conveyor 16, to swiftly transfer the stack to station 20 and then to load the stack into the entrance chamber 42G of the shuttle bucket mechanism 22.

As mechanism 22 shuttles or moves the stack of diapers 12 towards station 24, the stack, a compressible material, is gradually and uniformly compressed from a free-standing height, illustratively of 15 inches to a compressed height of 10 inches. Also, a front end 12A of the diaper stack is oriented 180° for positioning the stack in a chosen direction for bag loading. Illustratively, upon receipt of a stack 12 from conveyor 16, each diaper sheet of compressible material is folded in half with the folded edge of the diaper facing in a uniform manner the input station 20. The stack is about 15 inches tall. Stack 12 is pushed into entrance chamber 42G having top section 42B positioned to a height that compensates for the height of the diaper stack. Then the bucket 42 is shuttled from station 20 to station 24 on turntable 40. The drive mechanism (not shown) of turntable 40 drives pinion 40B along rack 40A towards station 24 causing the gimbal mechanism 44 to force the top section 42B to gradually slide downwardly over dowels 45 and to gradually compress the diaper stack 12 as the pinion and bucket are rotated clockwise for approximately 180° while being moved from station 20 to station 24. When the bucket reaches station 24, the stack of diapers are compressed to a height, illustratively of about 10 inches, which is coincident with the height of exit chamber 42H, the folded end of the diapers being positioned to face station 24. When the exit chamber 24H is achieved, slot 42K is formed providing a passageway for the arm 26A of the shuttle bucket unloading plunger 26 to travel when transferring the stack 12 to the bucket conveyor 28.

Figure 4:
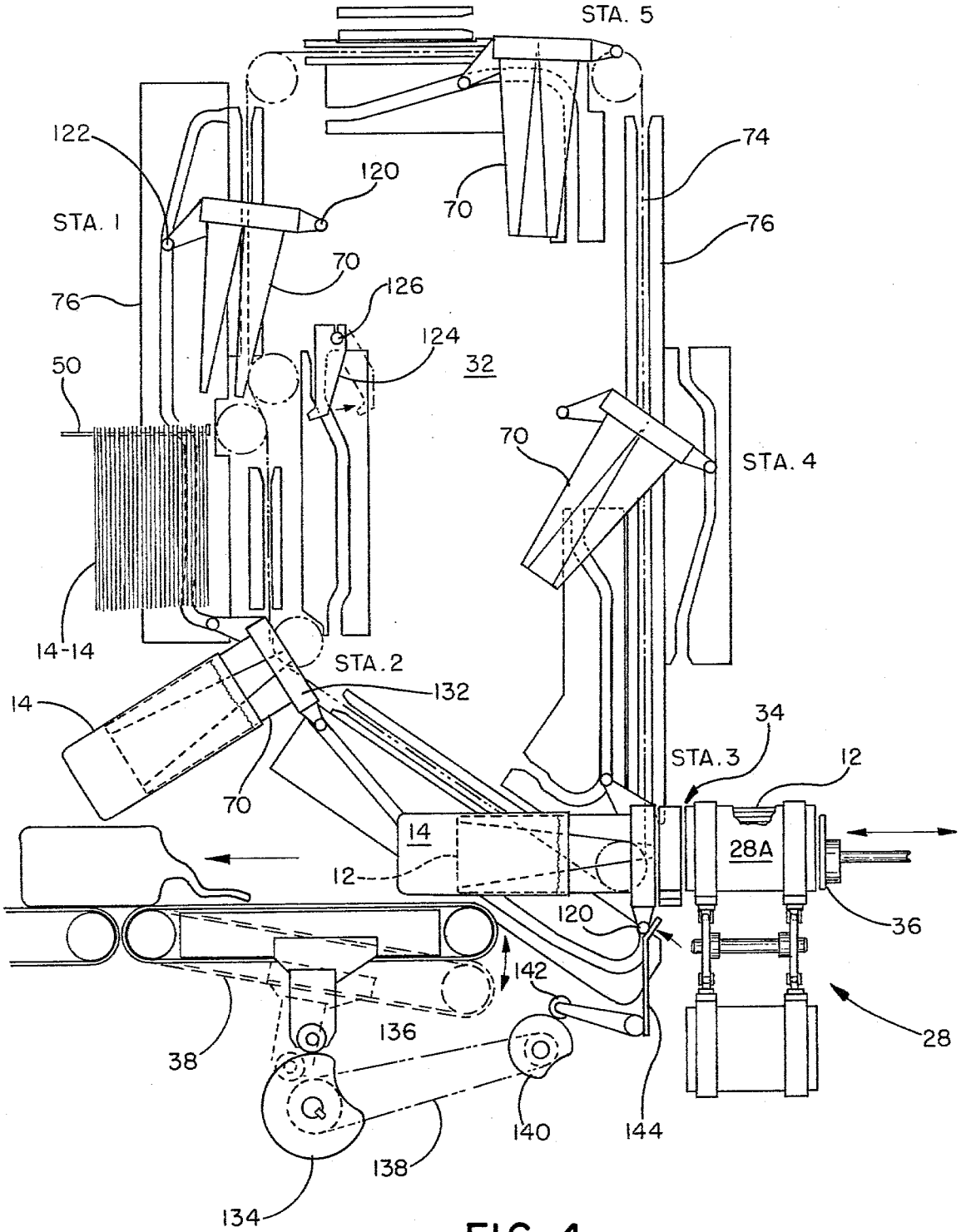
FIG. 4 is a plane view diagram illustrating the bag handling and conditioning mechanism.

Referring now to FIGS. 3 and 4, there is shown in FIG. 3 the bag supply magazine 30 for supplying bags automatically to the automatic bag handling and conditioning mechanism 32 of FIG. 4. Magazine 30 is, in this embodiment, approximately four feet in length and has a storage capacity of about 1000 drawstring plastic bags 14—14.

The bags 14—14 as illustrated in FIG. 3 are supplied illustratively with two one-half inch punched holes on the bag lip 14B which are used to support the bag on two, three-eighths inch diameter rods 50 so that the bags 14 hang in a vertical plane.

Magazine 30 comprises an automatically controlled bag pusher bar 52 for maintaining a constant supply of bags 14, from a first section 59 of the magazine, to bag handling mechanism 32 of FIG. 1, a bag supply sensor and control device 54 for controlling bar 52, a manually controlled bag pusher bar 56 for supplying bags from the second section 60 of the magazine to the first section 59, and an operating network 58 for manually controlling bar 56.

For controlling bag pusher bar 52, the bag supply sensor and control device 54 includes a first cable cylinder 54A, a source of air 54B, a first 60 PSI air regulator 54C, a lever operated 3-way valve 54D, a 20 PSI air regulator 54E, an air filter 54F, a pilot operated 2-way fluidic signal amplifier valve 54G, a first pilot operated 3-way valve 54H, a second pilot operated 3-way valve 54J, a first needle valve 54K, a second 60 PSI air regulator 54M, a second needle valve 54N and a third needle valve 54P.

For manually controlling bag pusher bar 56, the operating network 58 includes a second cable cylinder 58A, a 60 PSI air regulator 58B and a lever operated 3-way valve 58C.

During operation of the automatic bagging system 10, bag supply magazine 30 is used to provide a constant supply of bags 14 to a bag pickup and hook assembly 82 (the position whereat assembly 82 contact bag 14 is indicated by suction cups 82A shown in phantom; to be explained infra.) of the automatic bag handling and conditioning mechanism 32.

Initially, a plurality of bags are supplied by an operator to the second section 60 of the magazine 30. The operator stores the bags on a wicket 51 having two ends spaced to be in line with the three-eighth inch diameter rods 50 which extend the length of the magazine.

With the normally horizontally positioned pusher bars 52 and 56 manually positioned vertically downward and out of the path of the bags, the bags are loaded on rods 50 until both sections of the magazine are full. Once the magazine 30 is completely loaded, both bars 52 and 56 respectively are manually returned to the normal horizontal position. Thereafter, however, as more bags are needed, the bags are loaded only in the second section 60 of the magazine.

During operation of the automatic bag handling and conditioning mechanism 32, individual bags 14 are consecutively removed from magazine 30. Lever valve 54D is placed in the forward operating position to apply 60 PSI of air from source 54B to both a forward port 62 and a reverse port 64 of first cable cylinder 54A. Having 60 PSI of air applied to both sides of the cylinder 54A pusher bar 52 is maintained in a fixed horizontal position.

When a desired number of bags have been removed from the first section 59 of magazine 30, illustratively five bags, a reduced pressure between the head of sensor 54R and the bag 14 is sensed by sensor 54R, illustratively a pressure sensing transducer. The low pressure which is sensed by sensor 54R initiates a control signal X from sensor 54R to the pilot operated 2-way fluidic signal amplifier valve 54G to cause valve 54G to go from a normally off position to an on position causing a second control signal Y to be issued from valve 54G. The signal Y is applied to first 3-way valve 54H causing valve 54H to go, in turn, from ON to OFF, initiating a third control signal Z. Control signal Z is applied to normally ON pilot operated 3-way valve 54J to cause valve 54J to turn OFF disconnecting the 60 PSI air pressure going to reverse port 64 of the first cable cylinder 54A. At this time 60 PSI air pressure is maintained to the forward port 62 of the first cable cylinder 54A, causing the bag pusher bar 52 to gradually push additional bags forward against the sensor 54R and to cause the pressure sensed by sensor 54R to increase. When the pressure sensed by sensor 54R reaches 20 PSI, the valve 54J is turned ON, valve 54H is turned OFF, and valve 54G is again turned ON restoring 60 PSI of air pressure to both sides of the cable cylinder 54A. Needle valves 54K, 54N, and 54P are used to provide speed control exhaust air in lines opened during the bag sensing operations.

As the supply of bags is depleted, lever operated 3-way valve 58C is operated to move bags from the second section 60 of magazine 30 to the first section 59. Pusher bar 52 is positioned in a vertical plane, to allow bags to enter first section 59 when valve 58C is operated. Valve 58C supplies 60 PSI to a forward port of the second cable cylinder 58H to cause pusher bar to advance in the forward direction against the bags in section 60, pushing a supply of bags from section 60 to first section 59 of the magazine 30, replenishing the supply of bags therein.

With reference to FIGS. 4, 5, 6 and 7, there is shown the automatic bag handling and conditioning mechanism for: (1) automatically opening a bag 14 while the bag is still vertically suspended from rods 50 of FIG. 3; (2) automatically retaining the bag partially opened; (3) inserting a collapsed bag loading funnel 70 into the partially open bag to fully open the bag; (4) automatically opening the inserted funnel to form a tension stressed surface, box-like shaped bag and (5) moving and orienting the box-like shaped bag to the bag loading station 34 such that a stack of diapers 12 in a bucket 28A of bucket conveyor 28 can be loaded therein.

A plurality of funnels 70—70, illustratively, in this embodiment, five independent funnels are hingably and pivotally mounted at chosen locations to a continuous roller chain carrier 74 which is used to index each funnel to five differently oriented funnel stations along an ultra-high density polyethylene cam track 76. Carrier 74 is moved in synchronization with the bucket conveyor 28 such that a funnel is positioned at a funnel station each time a bucket 28 is positioned to bag loading station 34.

Figure 5:
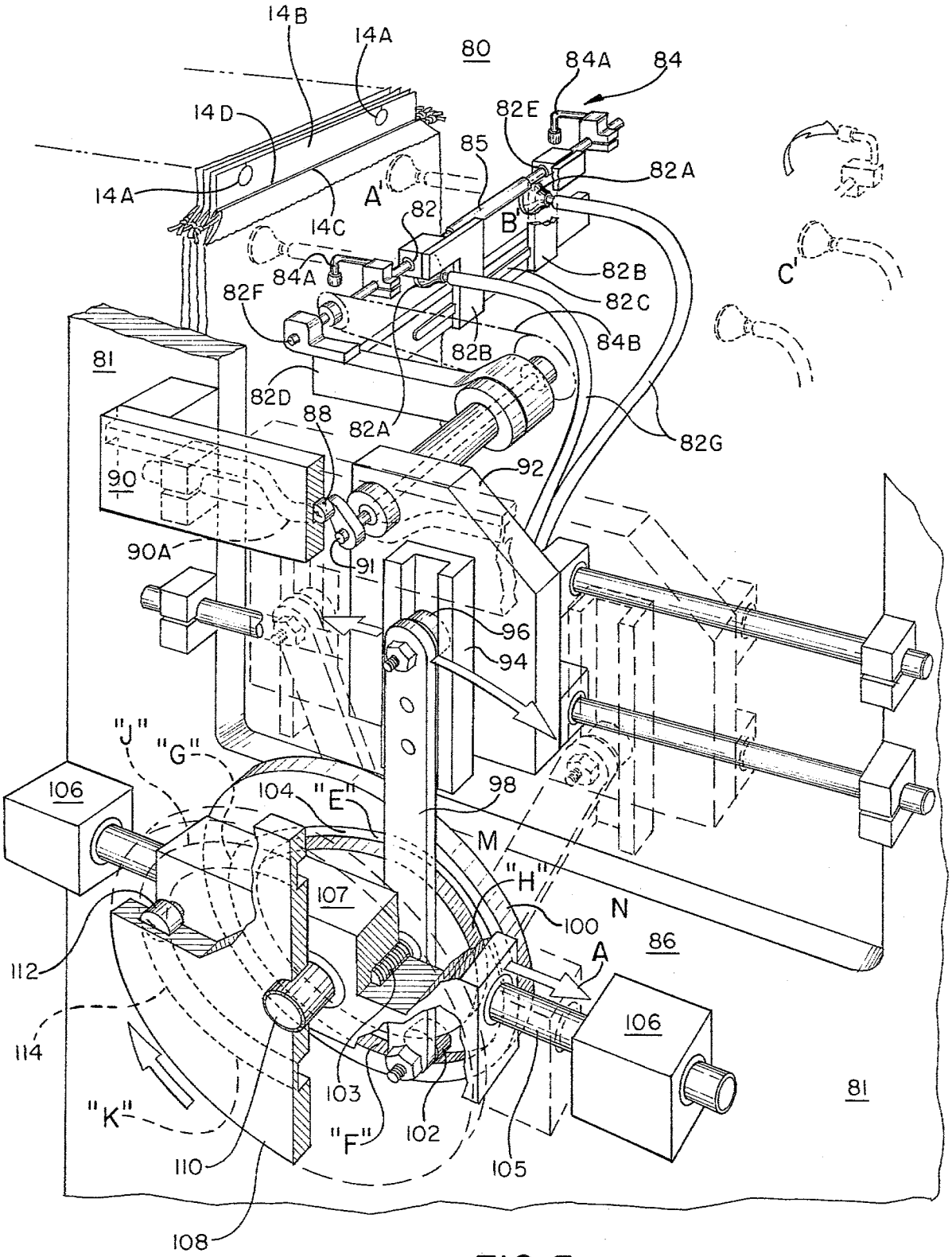
FIG. 5 is a perspective view of a bag hook pickup and hook assembly associated with the bag handling and condition mechanism of FIG. 4.

Between funnel stations 1 and 2, a bag pickup and hook assembly 80 of FIG. 5 is used to separate a first edge 14C from a second edge 14D of bag 14 so as to open the bag and to automatically hold open the bag so as to allow a collapsed funnel 70 to be inserted into the opened bag when the funnel is being moved from station 1 to station 2 of the cam track 76.

The bag pickup and hook assembly 80 which is mounted to a support member 81 of system 10 comprises a dual vacuum cup, bag pickup unit 82 for separating edge 14C from edge 14D of bag 14; a pivotal bag hook unit 84 for grasping edge 14C after edge 14C is separated from edge 14D, and a shuttle transporting unit 86 for moving both the bag pickup unit 82 and the bag hook unit 84 out of the path of the funnel as the funnel travels between station 1 and station 2. As the funnel 70 is moved from station 1 to station 2, the funnel enters the opened bag, rips the bag from the rods 50 at the aperatures 14A—14A and opens the box to the bag-like shape mentioned supra.

The dual vacuum cup, bag pickup unit comprises a pair of vacuum cups 82A—82A, mounted in a pair of generally L-shaped first members 82B. Members 82B have slot followers (not shown) at one end for moving in a slot 82C of a first housing 82D and a pair of bores 82E—82E which are used to slidably receive a dowel 85 swivelly mounted in an aperature 82F of first housing 82D. A vacuum source (not shown) and a programable switch (not shown) are used to provide a vacuum force through vacuum lines 82G—82G to the vacuum cups 82A—82A for drawing and separating edge 14C from edge 14D of bag 14.

The pivotal bag hook unit 84 includes a pair of bag hooks 84A—84A which are fixedly mounted to dowel 85 and a drive unit 84B connected to dowel 85 for rotating the hooks into bag 14 to grasp edge 14C and then to rotate out of bag 14 when funnel 70 is inserted. Hooks 84A—84A move in and out of bag 14 upon the reciprocation of a first cam follower 88 of a first box cam 90 which is fixedly mounted to a rotating shaft 91 of drive unit 84B.

Mounted to a surface of housing 92 is a slide 94 for guiding a first slide follower 96 that is fixedly mounted to one end of an arm 98. Arm 98 is pivotally coupled to a second box cam 100 at a pivot post 103 and by a second cam follower 102 which follows a cam track 104 of cam 100.

Cam 100 is fixedly attached to a drive shaft 110 of a synchronous drive source (not shown), and is drawn by shaft 110 to cause bag pickup action to occur between movement of the funnel 70 between stations 1 and 2.

Cam track 104, being shaped in parts substantially as first ellipsoidal curve "E", an inverse direction ellipsoidal curve "F" a first circular curve "G" and a second circular curve "H" is used when rotated about shaft 110 to create reciprocation and rotation of arm 98. The reciprocating and rotating motion of arm 98, in turn, causes second housing 92 to reciprocally move between a first position A and a second position B.

As second housing 92 is moved first cam follower 88 of the hook unit 84 travels in a track 90A which causes the first housing 82D to move between a corresponding first position A' to a second position B'.

Figure 6:
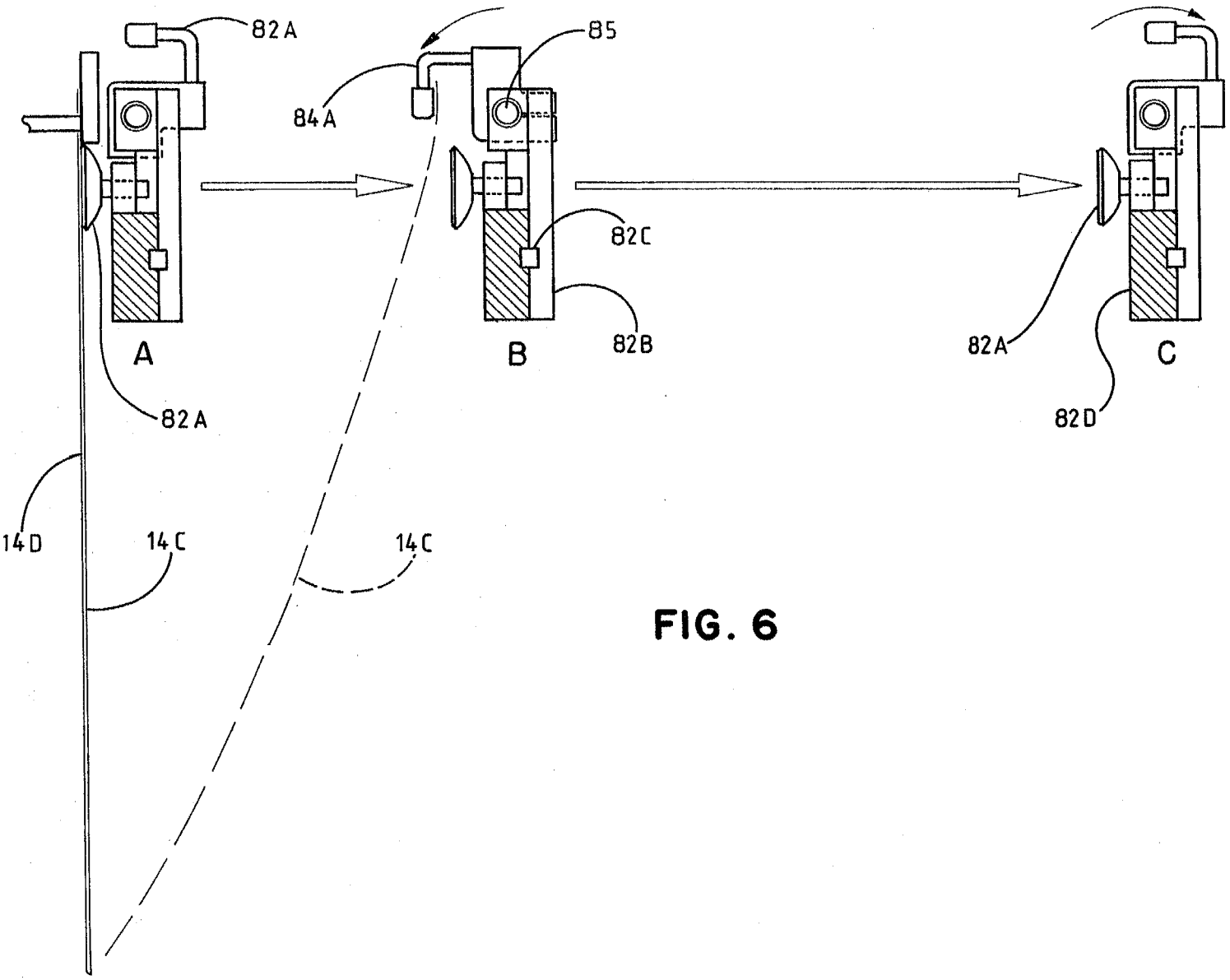
FIG. 6 is a functional diagram illustrating the function of a portion of the bag pickup and hook assembly when opening a bag and when the assembly is moved out of the path of a funnel entering the bag.

When first housing 82D is moved from position B' to position A' the vacuum switch is activated causing a vacuum force to exist at the vacuum cups 82. When the cups 82 enter position A', the bag lip 14C is contacted by the cups and the force of the vacuum as best shown in FIG. 6. As housing 82D is moved from position A' to position B', the edge of the bag 14C is pulled away from edge 14D; the bag hooks 84A are pivotally driven by drive unit 84 so as to grasp the edge 14C of the bag; and upon the grasping of the edge of hooks 84A, the vacuum switch automatically extinguishes the vacuum force.

The bag is retained in this open position to permit entry of collapsible bag loading funnel 70.

Upon entry of the funnel 70 into the opened bag 14, the first and second housings 82D and 92 are moved from positions B and B' to positions C and C' respectively. The pivot post 103, which is fixedly mounted in a third housing 107 is moved rearward from a first positon M likewise and as denoted by arrow A when housing 107 is slidably driven over a dowel 105 to a second position N. Dowel 105 is fixedly mounted between a pair of mounting blocks 106—106 of support member 81. Housing 107 is moved in synchronization with housings 92 and 82D by a third box cam 108 and an associated cam follower 112. Cam follower 112 is fixedly attached to third housing 107 and follows a third track 114 of cam 108. Cam 108 is used to move pivot post 103 and both the second housing 92 and the first housing 82D of the bag pickup and hook assembly out of the path of funnel 70 as the funnel travels between funnel stations 1 and 2. Cam 108, being shaped in parts substantially as an extended circular curve "J", and an extended ellipsoidal curve "K" is used to create the synchronous reciprocating motion required to permit moving pivot post 103 between positions M and N at the desired times to enable the bag pickup and hook assembly 80 to open the bag, retain the bag open in order for the funnel to be inserted and then just prior to the funnel ripping the bag from rods 50, to move the assembly 80 out of the path of the funnel.

Figure 7:
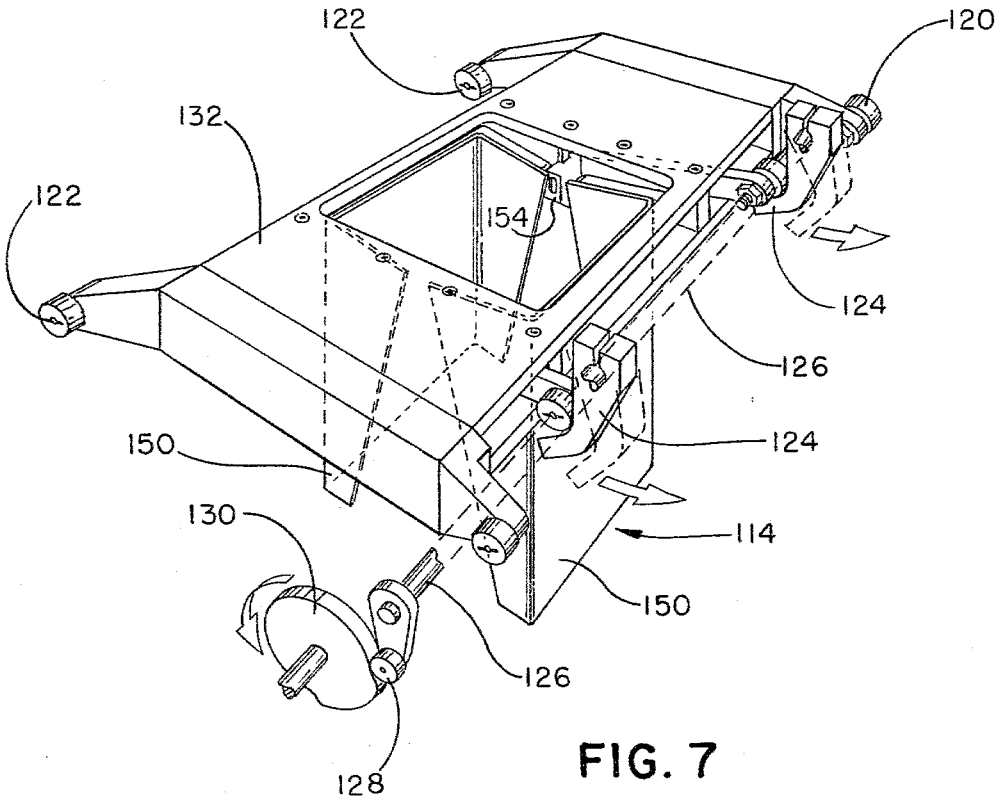
FIG. 7 is a perspective view of a funnel illustrated in the opened position.

Referring now to FIG. 4 and FIG. 7, as mentioned supra, and as shown in FIG. 4 funnels 70—70 are indexed from funnel station 1 through station 5. The funnels, which are hingably connected to the indexing roller chain carrier have a pair of funnel cam track followers, namely a first follower 120 and a second follower 122.

In order that the funnels may be conveniently maneuvered, the cam track 76 is desirably structured into several partially separated sectors such that the funnels are oriented in the defined direction of each funnel station during the dwell portion of travel of the indexing roller chain carrier 74.

As funnel 70 leaves station 1 and enters bag 14, a pair of toggle levers 124—124 contacts cam follower 120 which, in turn, opens the funnel as best seen in FIG. 7. Levers 124—124 are fixedly connected to a shaft 126; shaft 126 is connected to a funnel open cam follower 128; and cam follower is actuated by a continuously driven funnel open cam 130 which moves lever 124 out of the path of the remaining portions of the funnel as the funnel travels to funnel station 2.

As funnel 70 travels from station 2 to station 3, which is near bag loading station 34, the bag 14 along with the inserted and opened funnel 70 is oriented so that the bag reaches station 3, a rear portion of the bag 14 will rest on one end of package take-away conveyor 38 and a plate frame 132 of the funnel will be positioned at bag loading station 34.

During the dwell of roller chain carrier 74, and while funnel 70 is at rest at station 3, the bag loading plunger 36 is activated to push and transfer the stack of diapers 12 from bucket conveyor 28 into the opened bag 14. The motion of bag loading plunger 36 is such that the stack of diapers 12 are pushed into the bag 14, forming a package. The bag is, in turn, pushed off the opened funnel 70 and the bag with the diapers enclosed is pushed onto the package take-way conveyor 38 which transfers the package to a twist-tie station (not shown) for twist-tying the open end of the package.

Take-way conveyor 38 is continuously driven off of the main drive shaft. Conveyor 38 is also oscillated up and down by cam action of an oscillator cam 134 and cam oscillator cam follower 136 which is mounted to an under portion of conveyor 38 as shown in FIG. 4.

A drive network 138 is connected between cam 134 and a funnel closing cam 140 for driving cam 40 such that a cam follower wheel 142 can cause a funnel closing lever 144 to contact cam follower 120 which closes funnel 70 when funnel 70 is indexed from station 3 to station 4.

Figure 8:
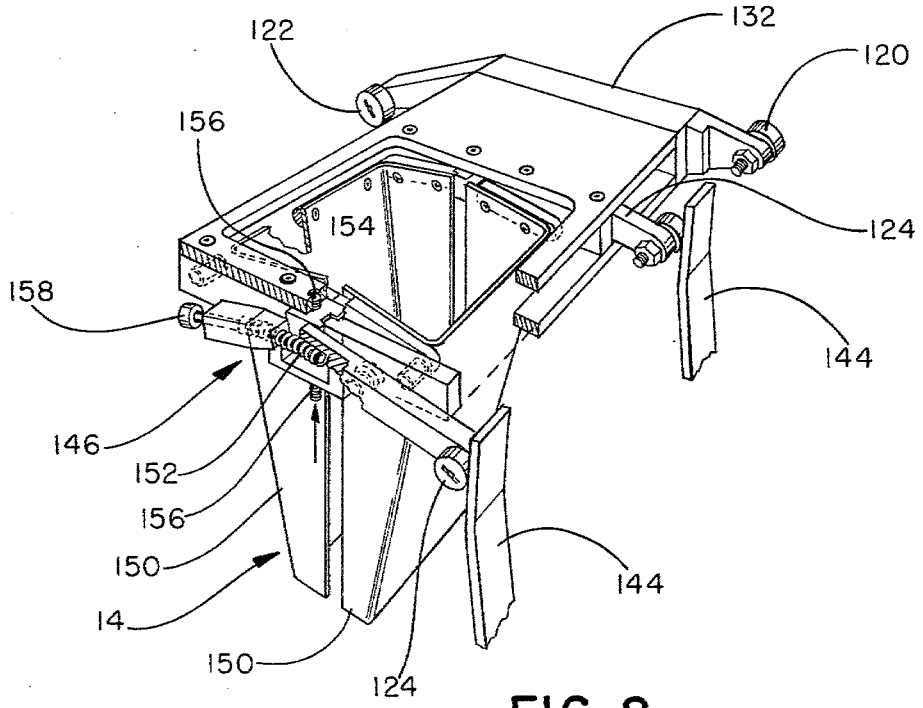
FIG. 8 is a perspective view of a funnel illustrated in the closed position.

Referring now to FIGS. 7 and 8, there is shown in FIG. 7 funnel 70 in the open configuration as it contacts toggle levers 124. Funnel 70 includes a pair of mechanically coupled half funnels 150 and a funnel opening and closing toggle mechanism 146 best seen in FIG. 8.

Funnel 70 also contains two adjustment devices namely, a pair of adjustment screws 156—156 for varying the tension placed on bag 14 by the half funnels 150—150 and a thumbscrew 158 for varying the tension of spring 152.

In FIG. 8, funnel 70 is illustrated in the closed configuration after it has been contacted by funnel closing lever 144. The toggle mechanism 146 includes a gear rack assembly 154 for pivoting the half funnels 150 about the plate frame 132 to achieve either the open or close configuration, and a toggle spring 152 for retaining the half funnels 150 in position after the gear track had been activated.

Figure 9:
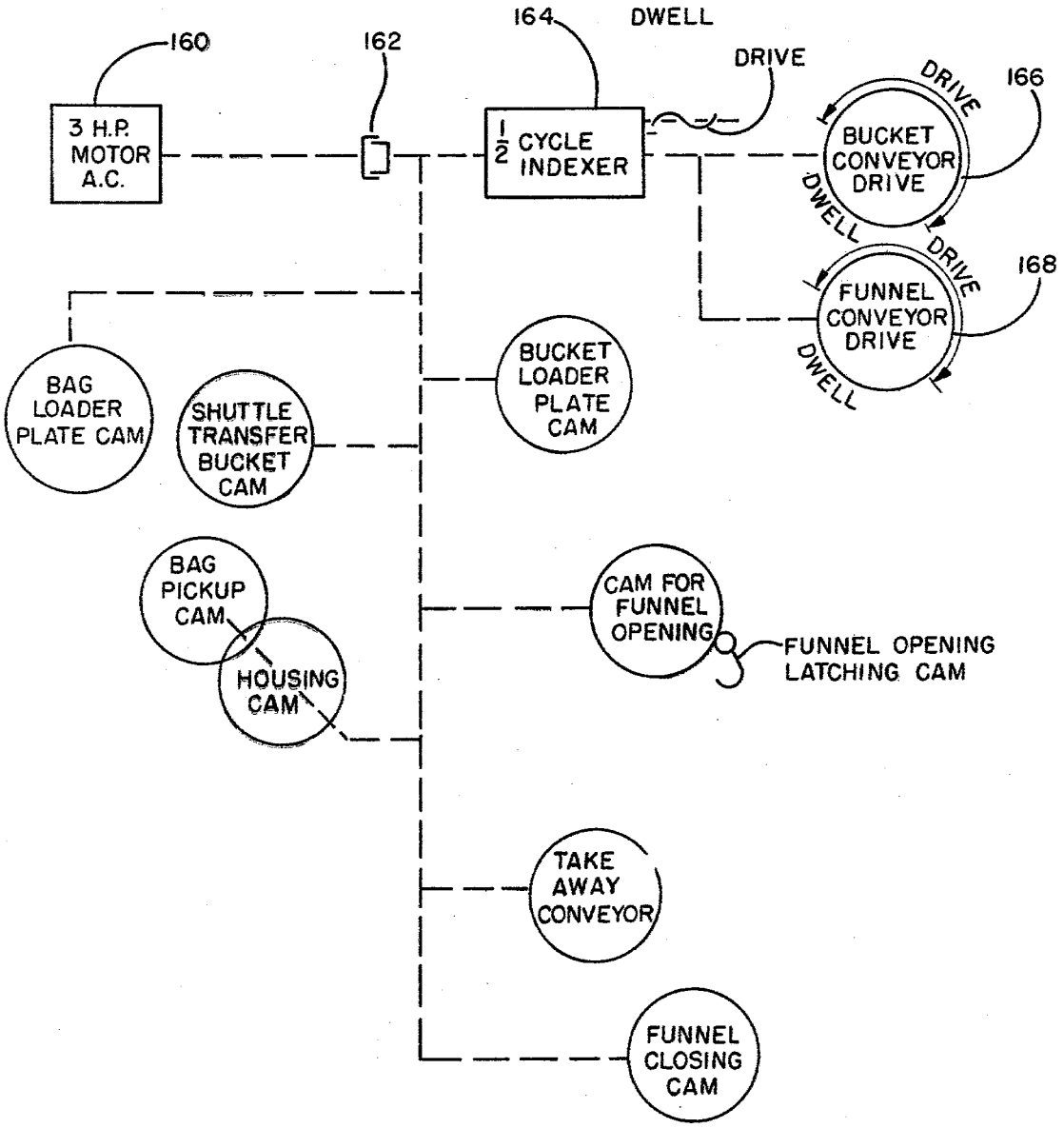
FIG. 9 is a block diagram illustrating the mechanical drive arrangements for driving the various cams of the system.

In FIG. 9, a block diagram is shown illustrating the mechanical drive arrangements for driving the various driven cams of the system. A three horsepower AC motor 160 provides the main drive source. A brake clutch 162 is used to stop and start the system without turning motor 160 OFF and ON. A half cycle indexer 164 is used to generate the indexing functions, namely dwell and drive, for indexing the bucket conveyor drive 166 and funnel conveyor drive 168. The remaining cam drives are driven directly from motor 160 and off of clutch 162 as indicated. The programable switch 170 for turning ON and OFF the vacuum for bag pickup is not shown. This switch is preprogramed to activate in conjuction with the bag pickup cam.

Figure 10:
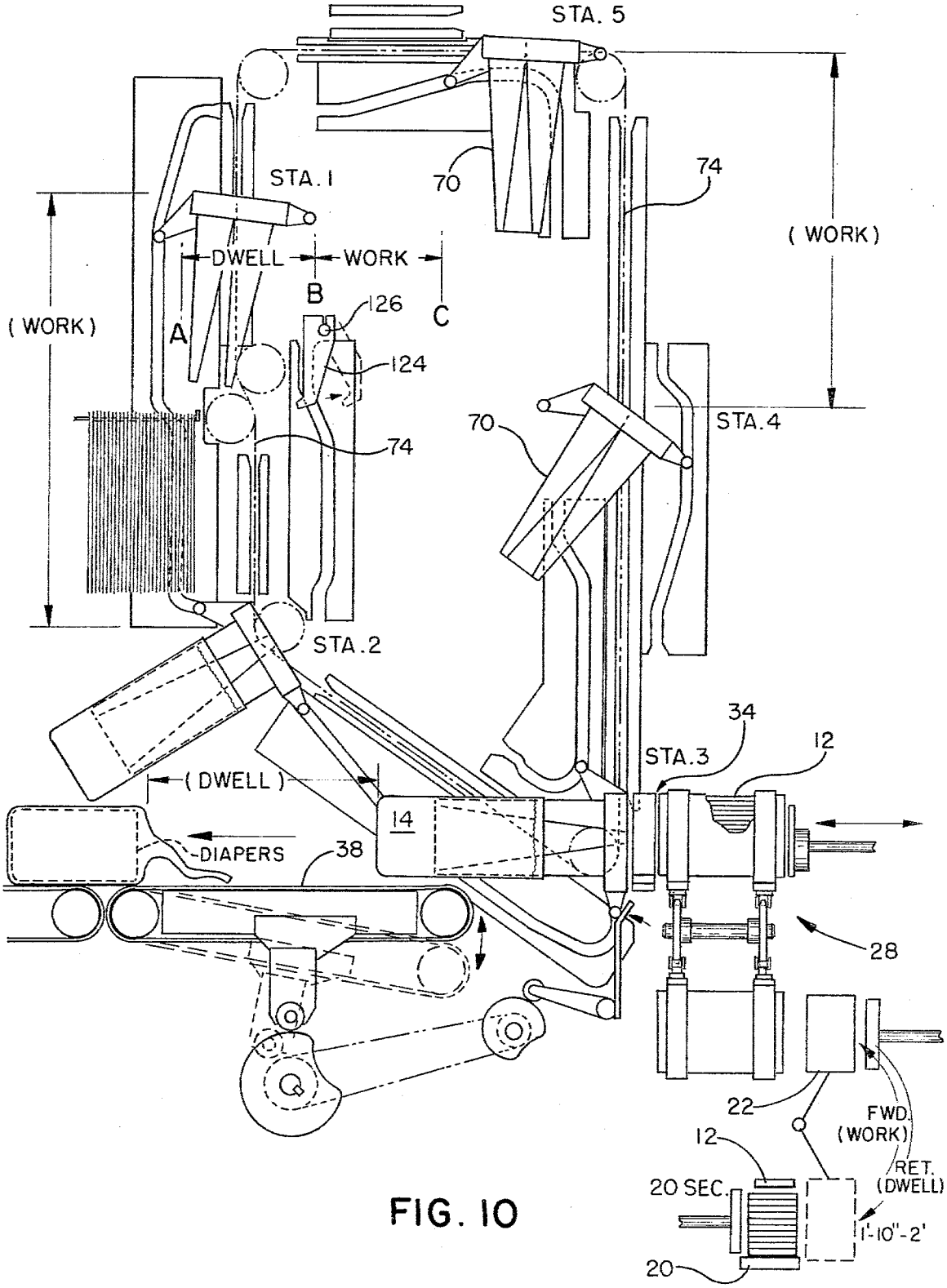
FIG. 10 is a functional diagram of the automatic bagging system illustrating various intervals of time required to accomplish various operations of the apparatus.

For an illustration of application of the principles of the present invention to package a stack of diapers in a drawstring plastic bag, reference is made to FIG. 10, which shows a functional diagram of the automatic bagging system 10. FIG. 10 includes various intervals of time representative of the time intervals required to accomplish the various operations described supra. Illustratively, within every three seconds of operation a stack of diapers 12 is presented at input station 20; another stack of diapers 12 is loaded into a drawstring plastic bag 14 at bag loading station 34; the bucket conveyor 28 is indexed by one bucket interval; the roller chain carrier 74 is operated to index each funnel from one funnel station to the next funnel station; and also all of the operations required to prepare the diapers for loading into a bag 14 at the bag loading station 34 are preformed simultaneously with all of the operations needed to condition the bag 14 for loading.

During each three second cycle, in which one half of the cycle is a work cycle and the other half is a dwell cycle, funnel 70 is moved from station 1 to station 2, illustratively, during the work portion of the cycle. However, the vacuum cup, bag pickup unit (not shown in FIG. 10) is moved forward to position A and back to position B during the dwell portion of the three second cycle and then out of the way of the funnel to position C during the work cycle. The shuttle bucket 22 is rotated clockwise to transfer a stack of diapers during the work portion and rotated counterclockwise back to the input station 20 to receive another stack of diapers during the dwell portion. During the dwell portion the packaging of the diapers is accomplished.

There are various other functions during this three second cycle which may be performed and incorporated into system 10, i.e., at station 2 during the dwell cycle, a code dating device (not shown) could be used to date the bag before the diapers are packaged; and at station 1, an article such as a coupon could be inserted in the bag by a coupon dispensing device (not shown).

Figure 11:
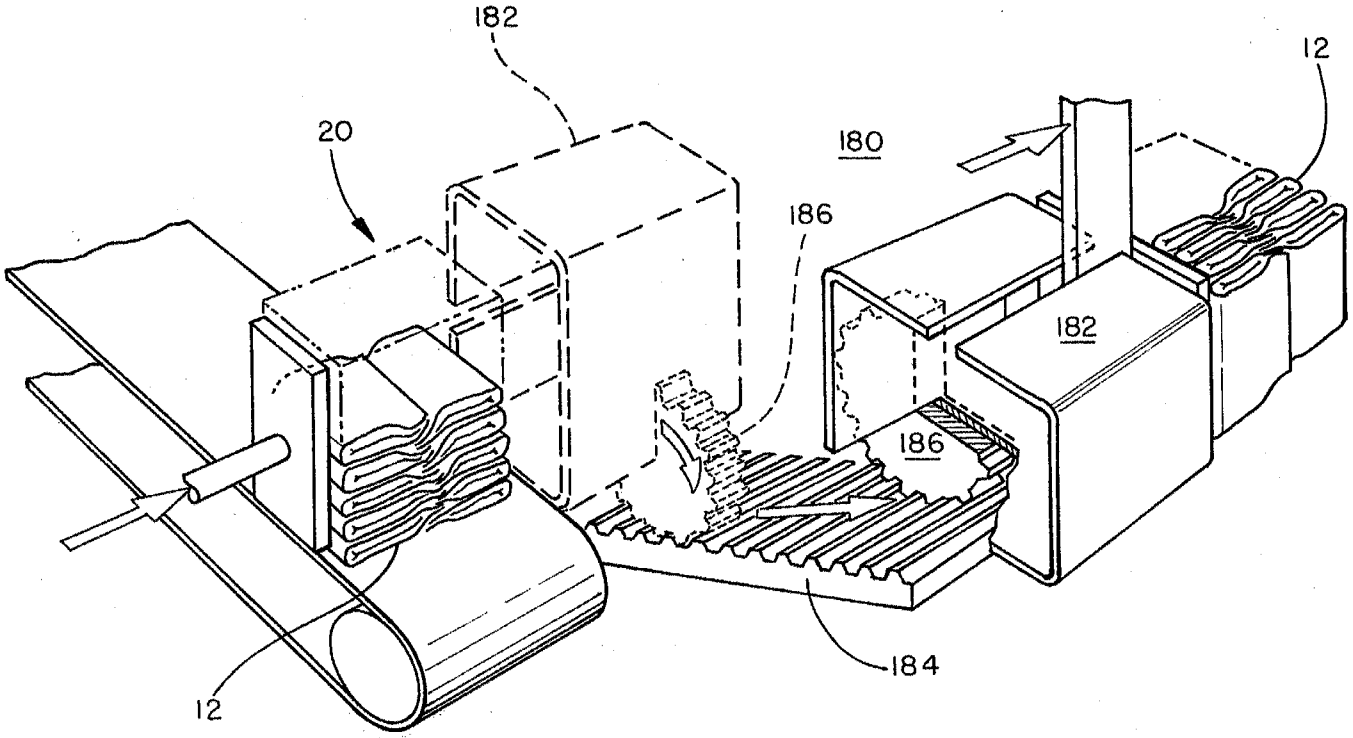
FIG. 11 is a functional perspective view of a modified shuttle bucket mechanism.

FIG. 11 illustrates a functional perspective view of a modified shuttle bucket mechanism 180. Shuttle bucket mechanism 180 is useful in applications where it is desirable to reorient a stack of diapers 90°. This mechanism, comprising a bucket 182, a rack 184 and a circular sector pinion 186 is disposed between the input station 20 and the shuttle bucket unloading station 24. No means are illustrated in FIG. 11 for compressing the diapers during transfer, but, however, a compression means can be incorporated as an additional feature.

Also, when this modified shuttle bucket mechanism 180 is incorporated into system 10, a corresponding modification to the bucket conveyor 28 and the funnels 70—70 must be made to accommodate the reoriented stack of diapers.

It is to be understood that the above-described embodiments are mainly illustrative of the principles of the invention. One skilled in the art may make changes and modifications to the embodiments disclosed herein and may devise other embodiments without departing from the scope and the essential characteristics thereof.

I claim:

1. A bagging system for bagging a stack of a compressible material into a plastic bag, wherein a material supply source supplies each stack of compressible material systematically and in consecutive order to said bagging system, wherein said stack of compressible material comprises a plurality of sheets of compressible material that are folded in half and stacked with the folded edges oriented in the same direction, said system comprising:

(a) an input station for receiving each stack of compressible material with the folded edge of each sheet oriented in a first direction, in line with the direction of travel of the stack from said supply source to said input station;

(b) a transfer station spaced from said input station for receiving each stack of compressible material with the folded edge of each sheet oriented in a second direction, 180° from the first direction;

(c) orienting means disposed between said input station and transfer station for moving each stack from said input station to said transfer station in a manner causing said stack to be compressed gradually from a free-standing height to a chosen compressed height while causing the folded edge of each sheet in said stack to be oriented in said second direction;

(d) a bag loading station spaced from said transfer station for bagging each stack of compressed material;

(e) a bucket conveyor means disposed between said transfer station and said bag loading station for transferring in consecutive order each compressed stack from said transfer station to said bag loading station;

(f) means for loading each stack of said compressed material into a bucket of said bucket conveyor.

(g) bag supply means for providing a continuous supply of vertically suspended bags;

(h) means for partially opening each vertically suspended bag supplied by said bag supply means, said means for partially opening each vertically suspended bag comprising (1) separating means for separating a first edge of each bag from a second edge at a lip of said bag, and (2) a retaining means for grasping and holding the first edge separated from the second edge;

(i) means for fully opening said bag to form a box-shaped bag having a tension stressed surface and positioning said fully opened box-shaped bag at said bag loading station in a manner to receive said compressed stack of folded material;

(j) bag loading means for transferring each stack of compressed material into the fully opened bags with the folded edge of each sheet of compressed material located at the opened end of said bag including (1) means for transferring each compressed stack of material in consecutive order from each bucket of said bucket conveyor into each opened bag supplied by the fully opened bag positioning means to form a package and simultaneously separating the package from the fully opened bag positioning means, (2) means for transferring the separated package to a twist-tie station, and (3) means for twist-tying the open end of the package at the twist-tie station.

2. Apparatus in accordance with claim 1 wherein said orienting means includes:

(a) a turntable means, said turntable means being comprised of a rack, a pinion, and a drive means for driving said pinion along said rack;

(b) a two-section bucket for holding each stack of compressible material, said bucket being open at both an entrance end and an exit end, said bucket having a bottom section fixedly mounted to said pinion of said turntable means;

(c) a gimbal mounting bracket positioned at a chosen location on said bagging system; and (d) a gimbal means disposed between said gimbal mounting bracket and a top section of said two-section bucket which comprises a shaft, a universal ball joint at one end of said shaft and a swivel bearing at the other end, said swivel bearing being pivotally hinged to a top surface of the top section of said two-section bucket and said universal ball joint being pivotally hinged to said mounting bracket.

3. Apparatus in accordance with claim 2 wherein said means for positioning a fully opened box-shaped bag at said bag loading station includes (a) a cam track, (b) a continuous roller chain carrier disposed on said cam track, (c) a plurality of collapsible funnels hingably and pivotally mounted to said chain carrier, (d) means for causing each funnel to enter the partially open bag and to fully open the bag and (e) means for transferring each fully opened bag to said bag loading station.

4. Apparatus in accordance with claim 1 including means for synchronizing the loading of the bag with the receipt of stacks of compressible material from the material supply source.

5. Apparatus in accordance with claim 1 wherein said orienting means includes means for transferring each stack of compressible material over through a 180° angular path from said input station of said transfer station.

6. Apparatus in accordance with claim 5 wherein said orienting means includes means for transferring each stack through from said input station to said transfer station.

* * * * *